US007219764B1

(12) United States Patent
Forbes

(10) Patent No.: US 7,219,764 B1
(45) Date of Patent: May 22, 2007

(54) EXHAUST MUFFLER

(75) Inventor: John Forbes, Grove City, MN (US)

(73) Assignee: Heartthrob Exhaust Inc., Litchfield, MN (US)

( * ) Notice: Subject to any disclaimer, the term of this patent is extended or adjusted under 35 U.S.C. 154(b) by 0 days.

(21) Appl. No.: 11/389,776

(22) Filed: Mar. 27, 2006

(51) Int. Cl.
*F01N 1/08* (2006.01)
*F01N 1/02* (2006.01)

(52) U.S. Cl. ..... 181/270; 181/272

(58) Field of Classification Search ..... 181/270, 181/275, 269, 281, 272, 264, 282, 268
See application file for complete search history.

(56) References Cited

U.S. PATENT DOCUMENTS

| | | | | |
|---|---|---|---|---|
| 1,184,431 | A * | 5/1916 | Dodge | 181/269 |
| 3,029,896 | A * | 4/1962 | Lyon | 181/269 |
| 3,945,684 | A | 3/1976 | Chellis | 303/1 |
| 3,966,016 | A | 6/1976 | Hecht | 181/57 |
| 3,987,868 | A | 10/1976 | Betts | 181/57 |
| 4,079,810 | A | 3/1978 | Prather et al. | 181/266 |
| 4,109,753 | A * | 8/1978 | Lyman | 181/252 |
| 4,574,914 | A | 3/1986 | Flugger | 181/268 |
| 4,809,812 | A | 3/1989 | Flugger | 181/264 |
| 4,958,701 | A | 9/1990 | Moring, III | 181/282 |
| 5,123,502 | A | 6/1992 | Flugger | 181/264 |
| 5,147,987 | A | 9/1992 | Richardson et al. | 181/264 |
| 5,214,253 | A | 5/1993 | Houston, Jr. | 181/238 |
| 5,216,883 | A | 6/1993 | Flugger | 60/313 |
| 5,262,600 | A | 11/1993 | Woods | 181/227 |
| 5,289,612 | A | 3/1994 | Glenn, III | 15/326 |
| 5,304,749 | A | 4/1994 | Crandell | 181/264 |
| 5,351,481 | A | 10/1994 | Flugger | 60/273 |
| 5,444,196 | A | 8/1995 | Woods | 181/227 |
| 5,444,197 | A | 8/1995 | Flugger | 181/264 |
| 5,451,728 | A | 9/1995 | Chandler et al. | 101/230 |
| 5,625,173 | A | 4/1997 | Woods | 181/227 |
| 5,739,484 | A | 4/1998 | Jones | 181/264 |
| 5,773,770 | A | 6/1998 | Jones | 181/268 |
| 5,892,186 | A | 4/1999 | Flugger | 181/252 |
| 5,936,210 | A | 8/1999 | Borneby et al. | 181/264 |
| 6,024,189 | A | 2/2000 | Heuser | 181/264 |
| 6,050,363 | A | 4/2000 | Tu | 181/264 |
| 6,089,347 | A | 7/2000 | Flugger | 181/264 |
| 6,109,026 | A | 8/2000 | Karlsson et al. | 60/302 |
| 6,164,412 | A | 12/2000 | Allman | 181/272 |
| 6,250,422 | B1 | 6/2001 | Goplen et al. | 181/272 |
| 6,257,367 | B1 | 7/2001 | Allman | 181/282 |
| 6,286,623 | B1 | 9/2001 | Shaya | 181/264 |
| 6,334,506 | B1 | 1/2002 | Hamrin et al. | 181/249 |
| 6,341,664 | B1 | 1/2002 | Gerber | 181/282 |
| 6,364,054 | B1 | 4/2002 | Bubulka et al. | 181/264 |
| 6,510,921 | B2 | 1/2003 | Price | 181/264 |

(Continued)

*Primary Examiner*—Edgardo San Martin
(74) *Attorney, Agent, or Firm*—Vidas, Arrett & Steinkraus, PA

(57) ABSTRACT

A muffler may comprise a casing having an internal volume, an inlet and an outlet, and a diverter plate dividing the internal volume into a first chamber and a second chamber. The diverter plate may comprise a baffle wall portion and at least one diverter having a deflecting surface oriented at an angle to the baffle wall portion. The baffle wall includes at least one aperture allowing fluid communication between the first chamber and the second chamber. The diverter is preferably suspended with respect to the casing, wherein no portion of the diverter directly contacts the casing.

22 Claims, 4 Drawing Sheets

U.S. PATENT DOCUMENTS

| | | | | |
|---|---|---|---|---|
| 6,571,910 | B2 | 6/2003 | Storm | 181/264 |
| 6,584,346 | B2 | 6/2003 | Flugger | 600/544 |
| 6,776,257 | B1 | 8/2004 | Shaya | 181/272 |
| 6,832,665 | B2 | 12/2004 | Crombeen | 181/275 |
| 6,889,499 | B2 | 5/2005 | Bassani | 60/312 |
| 2002/0112915 | A1* | 8/2002 | Price | 181/264 |
| 2005/0258001 | A1 | 11/2005 | Ryczek et al. | 181/272 |
| 2006/0054384 | A1* | 3/2006 | Chen | 181/272 |

* cited by examiner

EXHAUST MUFFLER

BACKGROUND OF THE INVENTION

This invention relates generally to mufflers and more particularly to sound attenuating exhaust mufflers for internal combustion engines.

Sound attenuating mufflers exist in the art, and as such their structure and function are well known. U.S. Pat. No. 4,574,914, U.S. Pat. No. 6,089,347, U.S. Pat. No. 6,286,623 and U.S. Pat. No. 6,341,664 disclose various muffler designs, the entire contents of which are incorporated herein by reference in their entireties.

While it is important for a muffler to attenuate engine noise, it is also desirable for a muffler to have sonic characteristics that are pleasing to the ear throughout the engine speed range. Desirable acoustics can range from a low RPM rumble to a crisp and aggressive high RPM exhaust note.

Muffler design also affects engine power output. A muffler preferably allows for a high exhaust flow rate.

There remains a need for novel muffler designs capable of producing desirable sound characteristics throughout the engine speed range while also providing sufficient noise attenuation and allowing sufficient flow and power characteristics. There remains a need for muffler designs that allow for a high flow rate with minimal drone at cruising speeds. There also remains a need for muffler designs having said functional characteristics that are less labor intensive and less expensive to manufacture than traditional designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, the invention is directed to a muffler comprising a casing having an internal volume, an inlet and an outlet, and a diverter plate dividing the internal volume into a first chamber and a second chamber. The diverter plate comprises a baffle wall portion and a diverter having a deflecting surface oriented at an angle to the baffle wall portion. The baffle wall includes at least one aperture allowing fluid communication between the first chamber and the second chamber. Exhaust gasses flowing through the muffler may pass through the aperture and be deflected against the deflecting surface of the diverter.

In at least one other embodiment, a diverter plate includes a first aperture, a second aperture, a first diverter and a second diverter. The shape of the first aperture may comprise a mirror image of the shape of the second aperture. The shape of the first diverter may comprise a mirror image of the shape of the second diverter.

A diverter plate may further comprise a connecting member connected between the first diverter and the second diverter.

In at least one other embodiment, a muffler comprises a casing having an internal volume, an inlet, an outlet and a diverter plate. The diverter plate divides the internal volume into a first chamber and a second chamber, the first chamber having the inlet and the second chamber having the outlet. The diverter plate comprises a first diverter, a second diverter and a baffle wall portion having at least one aperture. The first diverter and the second diverter are oriented at equal but opposite angles with respect to the baffle wall portion. The first diverter and the second diverter extend into the second chamber. The at least one aperture allows fluid communication between the first chamber and the second chamber.

In at least one other embodiment, the invention is directed to a method of making a muffler comprising: providing a casing having an internal volume; providing a diverter plate; orienting the diverter plate within the internal volume of the casing; and securing the diverter plate to the casing. The diverter plate may comprise a baffle wall portion and a diverter having a deflecting surface oriented at an angle to the baffle wall portion.

In some embodiments, the step of providing a diverter plate further comprises providing a sheet of material and stamping the sheet to form the baffle wall portion, the aperture and the diverter.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
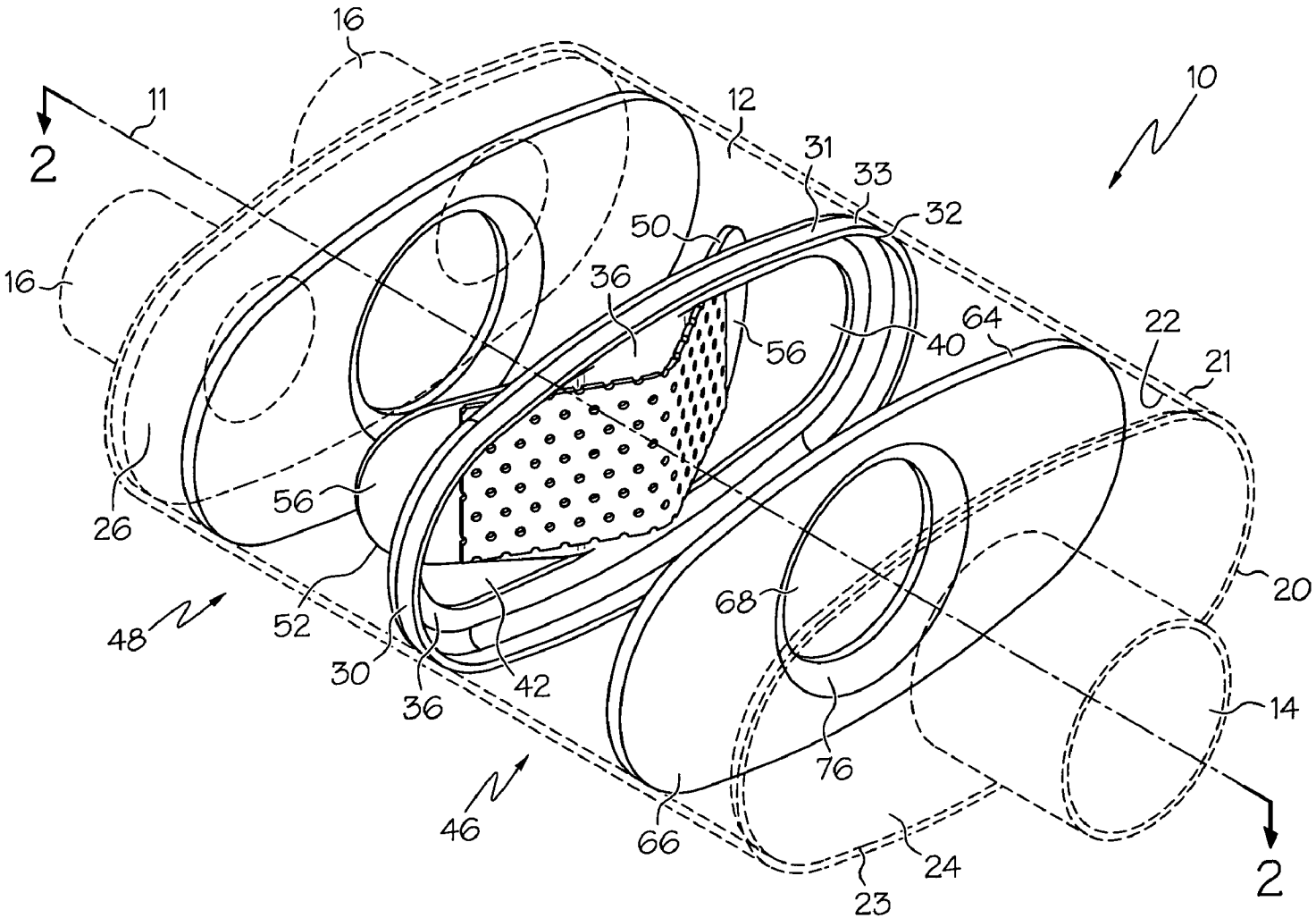
FIG. 1 shows an embodiment of a muffler.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
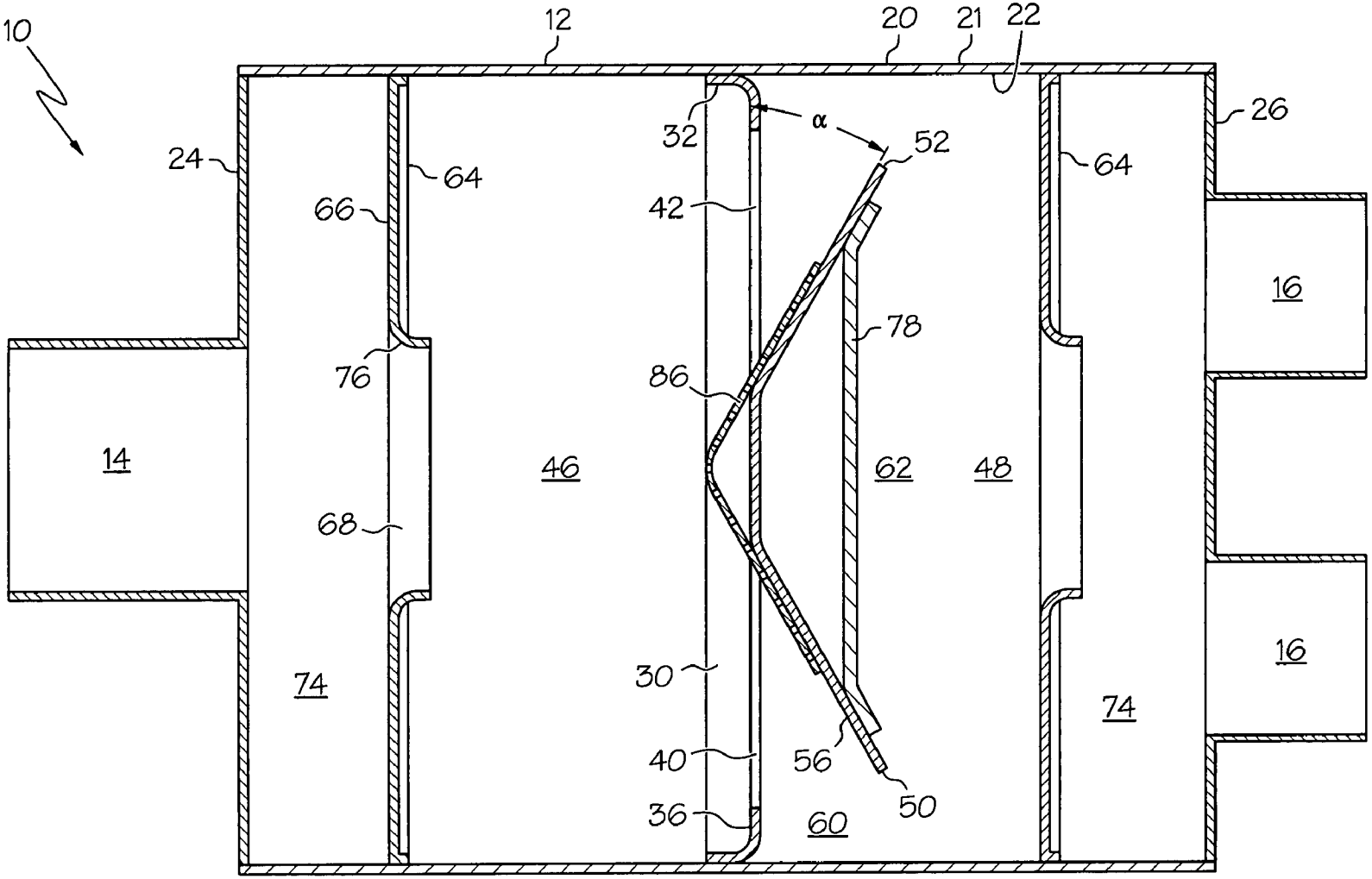
FIG. 2 shows a sectional view of the muffler of FIG. 1 taken across line 2—2 of FIG. 1

FIGS. 1 and 2 show an embodiment of a muffler 10 comprising a casing 12, at least one inlet 14, at least one outlet 16 and a diverter plate 30. Exhaust gasses may enter through the inlet 14, pass through the muffler 10 and exit through the outlet(s) 16.

The casing 12 may have any suitable cross-sectional shape and in various embodiments may have a rectangular, circular or oval cross-sectional shape. The casing 12 may define an outer shape of the muffler 10, and a central longitudinal axis 11 of the casing 12 may comprise a central longitudinal axis 11 of the muffler 10.

The casing 12 may comprise a wall 20 that defines an internal volume. The wall 20 may have an inner surface 22 and an outer surface 21. In some embodiments, the wall 20 may comprise a single layer of material. In some embodiments, the wall 20 may comprise multiple layers of material, for example a first layer and a second layer oriented coaxially, or a continuous sheet of material wrapped spirally such that any portion of the wall 20 comprises at least two layers of material.

The casing 12 may further comprise a first end plate 24 and a second end plate 26. The first end plate 24 may house the inlet 14 and the second end plate 26 may house the outlet(s) 16. The end plates 24, 26 may be fixedly attached to an edge 23 of the wall 20, for example by welding.

The diverter plate 30 may comprise a baffle wall portion 36 and may separate the internal volume of the casing 12 into a first chamber 46 and a second chamber 48. In some embodiments, the diverter plate 30 may be positioned approximately halfway between the first end plate 24 and the second end plate 26. An outer perimeter 31 of the diverter plate 30 may be shaped similarly to the cross-sectional shape of the casing 12 and may abut the inner surface 22 of the casing 12. The diverter plate 30 may be fixedly attached to the casing 12 using any suitable method, for example by welding.

In some embodiments, the diverter plate 30 may have a flange 32 which may add structural integrity, aid in positioning the diverter plate 30 within the casing 12 and provide an attachment surface. A flange 32 may have any suitable size, shape and orientation, and preferably has an outer surface 33 oriented orthogonally to the baffle wall 36.

The baffle wall portion 36 may have any suitable shape and preferably comprises a planar surface. The baffle wall 36 may have any suitable orientation within the casing 12 and is preferably oriented orthogonally to the longitudinal axis 11.

The diverter plate 30 may have at least one aperture 40, and in some embodiments may have multiple apertures 40, such as a first aperture 40 and a second aperture 42. The aperture(s) 40 allow fluid communication between the first chamber 46 and the second chamber 48.

Figure 3:
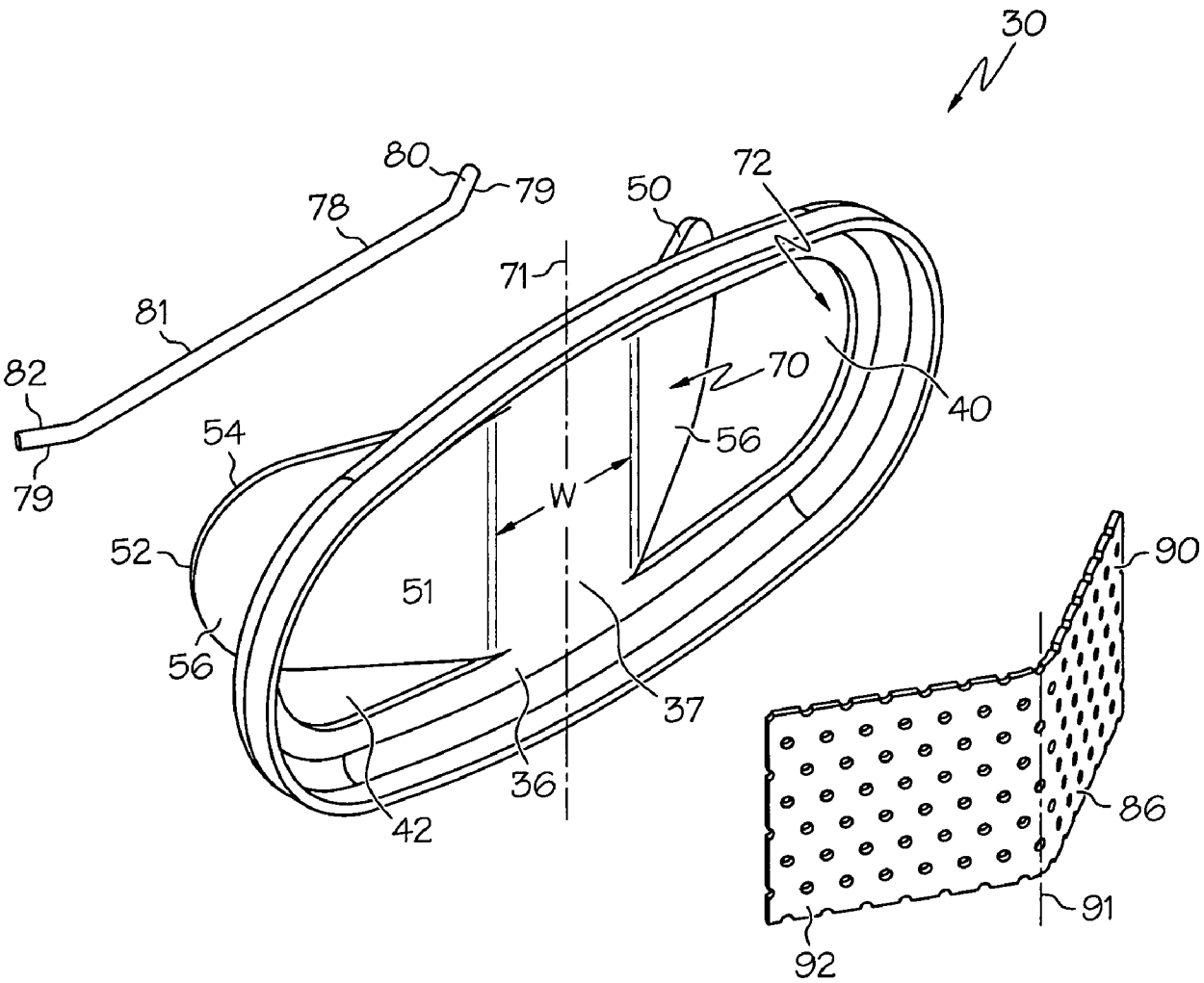
FIG. 3 shows an exploded view of an embodiment of a diverter plate.
Figure 4:
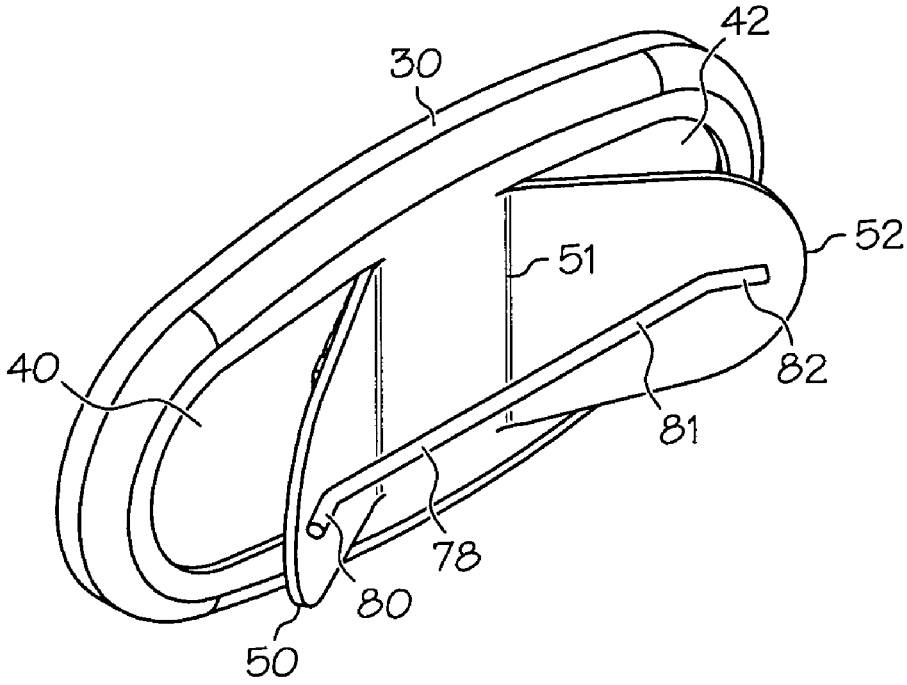
FIGS. 4 and 5 show further views of an embodiment of a diverter plate.

FIG. 3 shows an exploded view of an embodiment of a diverter plate 30, and FIG. 4 shows another view of an embodiment of a diverter plate 30. Each aperture 40 may have any suitable shape and may be formed in the diverter plate 30 using any suitable method. In some embodiments, an aperture 40 may comprise a D-shape, having a straight portion 70 and a curved portion 72. The straight portion 70 may be oriented vertically. The curved portion 72 may be oriented outwardly from the straight portion 70 with respect to the longitudinal axis 11 of the muffler 10. In some embodiments, the curvature of the curved portion 72 may be similar to the curvature of the inner surface 22 of the casing 12.

In some embodiments, a first aperture 40 and a second aperture 42 may have a similar shape. In some embodiments, the shape of a first aperture 40 may comprise a mirror image of the shape of a second aperture 42. The mirror image may be taken across any suitable axis, such as a vertical axis 71 that may intersect the longitudinal axis 11 of the muffler 10.

In various embodiments, the total area of the aperture(s) 40 may comprise any suitable percentage of the total cross-sectional area of the diverter plate 30 or of the cross-sectional area of the casing 12. In some embodiments, the total area of the aperture(s) 40 may comprise 20–60% of the cross-sectional area of the casing 12. In some embodiments, the total area of the aperture(s) 40 may comprise 30–40% of the cross-sectional area of the casing 12.

In some embodiments, the total area of the aperture(s) 40 may be equal to or greater than the cross-sectional area of the inlet 14 of the muffler 10.

The diverter plate 30 further comprises at least one diverter 50. A diverter 50 may have any suitable size and shape, and may have any suitable orientation within the muffler 10. In some embodiments, a diverter 50 is attached to the baffle wall portion 36 at one end and extends into the second chamber 48 (see FIG. 2). In some embodiments, multiple diverters 50 may be provided, for example, one diverter 50 for each aperture 40. Each diverter 50 may comprise a deflecting surface 56 that is oriented at an angle to the baffle wall portion 36. In some embodiments, the deflecting surface 56 may comprise a planar surface. Exhaust gasses flowing through the muffler 10 may pass through an aperture 40 and be deflected by a diverter 50.

A diverter 50 may be located immediately adjacent to an aperture 40. In some embodiments, the shape of a diverter 50 may be similar to the shape of an aperture 40, for example comprising a D-shape, having a straight portion 51 and a curved portion 54. The straight portion 51 may be aligned with a straight portion 70 of a D-shaped aperture 40. A curved portion 54 helps exhaust gasses to flow around the diverter 50 and reduce turbulence.

In some embodiments, a diverter 50 may be made from a separate piece of material and attached to the baffle wall 36 or any other portion of the diverter plate 30 using any suitable method, such as welding, crimping, swaging, etc. In some embodiments, an edge portion of a diverter 50 may abut and/or be attached to an edge portion of the baffle wall 36 that defines an aperture 40.

In some embodiments, a diverter 50 and the baffle wall 36 may be formed from a single, continuous piece of material. For example, a single piece of material may be stamped to form one or more diverters 50 and a baffle wall 36 having one or more apertures 40. Thus, in some embodiments, material removed from the baffle wall 36 to form an aperture 40 may be used to form a diverter 50.

Preferably, the diverter(s) 50 are "suspended" with respect to the casing 12, wherein no portion of the diverter 50 directly contacts the casing 12. In some embodiments, each diverter 50 may be supported only by a connected edge where the diverter 50 attaches to the baffle wall 36 of the diverter plate 30. The suspended diverter(s) 50 reduce the amount of drone and noise experienced outside of the muffler, as much of the vibration experienced by a diverter 50 is not directly imparted to the casing 12.

FIG. 2 shows a sectional top view of an embodiment of the muffler 10. Exhaust gasses flowing through the muffler 10 may pass through the first chamber 46, through an aperture 40 and be deflected by the deflecting surface 56 of a diverter 50. The deflection of exhaust gasses creates a high pressure zone 60 in the area of the deflected gasses to one side of the diverter 50 and a low pressure zone 62 in the area behind the diverter 50.

In some embodiments, the diverter(s) 50 are oriented such that deflected exhaust gasses are directed outward, i.e. away from the central axis 11 (see FIG. 1) of the muffler 10. In other embodiments, the diverter(s) 50 may be oriented to direct exhaust gasses in any suitable direction.

The deflecting surface 56 of a diverter 50 may be oriented at any suitable angle $\alpha$ with respect to the baffle wall 36. In some embodiments, the angle $\alpha$ may range from 10 to 80 degrees. In some preferred embodiments, the angle α may range from 20 to 50 degrees. In some preferred embodiments, the angle α may range from 25 to 35 degrees.

In some embodiments, the diverter plate 30 may comprise a first diverter 50 and a second diverter 52. The first diverter 50 may be adjacent to the first aperture 40, and the second diverter 52 may be adjacent to the second aperture 42. The first diverter 50 and the second diverter 52 may comprise a similar shape. In some embodiments, the shape of a first diverter 50 may comprise a mirror image of the shape of a second diverter 52. The mirror image may be taken across any suitable axis, such as a vertical axis 71 (see FIG. 3).

In preferred embodiments, the deflecting surface 56 of a first diverter 50 and the deflecting surface 56 of a second diverter 52 may be oriented at equal but opposite angles α with respect to the baffle wall 36. Thus, the deflecting surface 56 of the first diverter 50 and the deflecting surface 56 of the second diverter 52 may be symmetrical across the longitudinal axis 11, and may be oriented at equal but opposite angles with respect to the longitudinal axis 11. In other embodiments, a first diverter 50 and a second diverter 52 may comprise different shapes, may be oriented at different angles α, and/or may otherwise be asymmetrical across the longitudinal axis 11.

The diverter plate 30 may comprise any material suitable to withstand the high temperatures encountered during operation. The diverter plate 30 preferably comprises a metal such as steel. In various embodiments, diverter(s) 50 may comprise the same material as other portions of the diverter plate 30, or may comprise one or more different materials.

Figure 5:
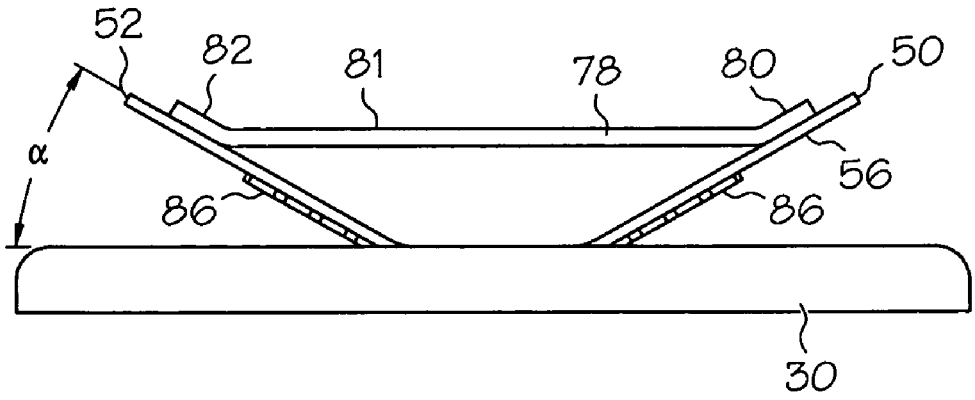

Referring to FIGS. 3–5, in some embodiments, a diverter plate 30 may further comprise a connecting member 78. In some embodiments, a diverter plate 30 may further comprise a splitter plate 86.

A connecting member 78 may comprise a reinforcing structural connection between a first diverter 50 and a second diverter 52. A connecting member 78 may have any suitable cross-sectional shape. The connecting member 78 adds rigidity to the diverter plate 30 and transfers vibrations between a first diverter 50 and a second diverter 52, thereby damping ringing or tuning fork oscillations in the diverters 50, 52. The connecting member 78 allows cancellation of soundwaves and vibrations in the diverters 50, 52 without requiring the diverters 50, 52 to be attached to the casing 12. The connecting member 78 also helps to provide symmetry across the longitudinal axis 11 during operation and may help to ensure that exhaust flow is equally divided between a first aperture 40 and a second aperture 42.

The connecting member 78 may be attached to a first diverter 50 and a second diverter 52 using any suitable method, and is preferably fixedly attached, for example by welding. A connecting member 78 may be attached to any suitable location on the diverters 50, 52. Desirably, the connecting member 78 connects to similar locations on each diverter 50, 52 (i.e. symmetrical across the longitudinal axis 11). In some embodiments, a connecting member 78 connects to outward locations on the diverters 50, 52, for example connecting to a portion of each diverter 50, 52 that is opposite or spaced away from the portion of each diverter 50, 52 that is connected to the baffle wall portion 36.

In some embodiments, the connecting member 78 may comprise a first connecting portion 80, an elongate portion 81 and a second connecting portion 82. The elongate portion 81 may span between the first connecting portion 80 and the second connecting portion 82.

In some embodiments, the elongate portion 81 may be oriented parallel to the baffle wall 36. The first connecting portion 80 may comprise an attachment surface 79 that is parallel to the first diverter 50, and the second connecting portion 82 may comprise an attachment surface 79 that is parallel to the second diverter 52. Each attachment surface 79 may abut and be attached to a diverter 50, 52. Each attachment surface 79 may be attached to a surface of a diverter 50, 52 that is oriented opposite the deflecting surface 56.

A splitter plate 86 may help to divide the flow of exhaust gasses between a first aperture 40 and a second aperture 42. The splitter plate 86 may further help to prevent exhaust gasses passing through the first chamber 46 from being reflected back toward the inlet 14. A central portion 37 of the baffle wall 36 may be oriented between the first aperture 40 and the second aperture 42. In some embodiments, the central portion 37 may be oriented such that exhaust gasses that flow into the central portion 37 may be reflected back toward the inlet 14. The splitter plate 86 may comprise an extension of the deflecting surfaces 56 of the diverters 50, 52, and may be positioned substantially between the inlet 14 and the central portion 37 of the baffle wall 36.

In some embodiments, a splitter plate 86 may comprise a first portion 90 and a second portion 92. The first portion 90 may be oriented at an angle to the second portion 92. A central portion of the splitter plate 86 may comprise a bend 91. The first portion 90 may comprise a substantially planar surface that is oriented parallel to the deflecting surface 56 of the first diverter 50. The second portion 92 may comprise a substantially planar surface that is oriented parallel to the deflecting surface 56 of the second diverter 52. The first portion 90 may be fixedly attached to the first diverter 50 and the second portion 92 may be fixedly attached to the second diverter 52, for example by welding. The splitter plate 86 may be positioned such that the central portion 91 is aligned with the central longitudinal axis 11 of the muffler 10.

A splitter plate 86 may be particularly desirable when a width dimension W of the central portion 37 of the baffle wall 36 is equal to or greater than one inch.

In some embodiments, a splitter plate 86 may comprise a plurality of apertures 88, for example oriented in a pattern as depicted in the Figures. In some embodiments, a plurality of apertures 88 oriented in a line may help to form a bend 91.

In an alternative embodiment (not shown), rather than using a splitter plate 86 having a first portion 90 and a second portion 92 as described herein, individual extension pieces may be used to extend the deflecting surface 56 of each deflector 50.

Referring again to FIGS. 1 and 2, in some embodiments, a muffler 10 may further comprise one or more baffle plates 64. A baffle plate 64 may comprise a baffle wall 66 and at least one fluid passageway 68. Each baffle plate 64 may be oriented within the casing 12 and may divide the internal volume of the casing 12 to define an additional chamber 74. As shown in FIG. 2, the baffle plates 64 are positioned such that the first chamber 46 and the second chamber 48 each comprise approximately 30% of the internal volume of the casing 12. Each additional chamber 74 comprises approximately 20% of the internal volume of the casing 12.

In some embodiments, a baffle plate 64 may comprise a flange, for example being similar to the flange 32 of a diverter plate 30. In some embodiments, the baffle wall 66 of a baffle plate 64 may be oriented orthogonally to the longitudinal axis 11 of the muffler 10. In some embodiments, the fluid passageway 68 may comprise a shaped or radiused end portion 76 which may reduce turbulence in the flowing exhaust gasses.

The number of baffle plates 64 used in the muffler 10, the location of each baffle plate 64, the number of fluid passageways 68 and the area of each fluid passageway 68 may be adjusted in order to tune the sound characteristics of the muffler 10. In some embodiments, a baffle plate 64 may be positioned with a fluid passageway 68 directly adjacent to the low pressure zone 62 created by the diverter plate 30.

In some alternative embodiments, a diverter 50 and/or the deflecting surface 56 of a diverter may include curvature. Curvature may be about any suitable axis, such as a vertical axis. The curvature of a deflector 50 may be convex or concave, for example deflecting exhaust gasses in convergent directions or in divergent directions.

In some alternative embodiments, diverters 50 and apertures 40 may have other shapes and/or orientations. For example, a diverter 50 may have a straight portion 51 that is oriented horizontally. A second diverter may comprise a mirror image of a first diverter, wherein the mirror image is taken across a horizontal axis. A diverter 50 may have a straight portion 51 that is located farther away from the longitudinal axis 11 of the muffler 10 than any other portion of the diverter 50. Various apertures 40 used with such alternative embodiments may be shaped accordingly.

In some embodiments (not shown), the baffle wall 36 may have a bend or may otherwise comprise a first baffle wall portion oriented at an angle to a second baffle wall portion. The first baffle wall portion may be oriented at an angle to the longitudinal axis 11 of the casing 12, while the second baffle wall portion may be oriented at an equal but opposite angle to the longitudinal axis 11.

The invention is further directed to methods of making a muffler 10 having a diverter plate 30. A method may include the steps of providing a casing 12 having an internal volume, providing a diverter plate 30, orienting the diverter plate within the internal volume of the casing 12, and securing the diverter plate 30 to the casing 12.

In some embodiments, the step of providing a diverter plate 30 may further comprise providing a sheet of material and stamping the sheet to form the baffle wall portion 36, the aperture(s) 40 and the diverter(s) 50. In some embodiments, the stamping step may also include forming a flange 32.

In some embodiments, the step of providing a diverter plate 30 may further comprise providing a connecting member 78 and attaching the connecting member 78 to the diverter(s) 50. In some embodiments, the step of providing a diverter plate 30 may further comprise providing a splitter plate 86 and attaching the splitter plate 86 to the diverter(s) 50

In some embodiments, the step of providing the casing 12 may comprise providing a sheet of material and rolling the sheet to form the wall portion 20. In some embodiments, this may comprise double wrapping the sheet to form a wall portion 20 that is at least two layers thick in all locations.

In some embodiments, the step of providing the casing 12 may further comprise providing a first end plate 24 and a second end plate 26, and attaching the respective end plates 24, 26 to the wall portion 20.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A muffler comprising:

a casing having an internal volume, an inlet and an outlet; and a diverter plate dividing the internal volume into a first chamber and a second chamber, the diverter plate comprising a baffle wall portion, a first diverter, a second diverter and a connecting member that is separate and distinct from the baffle wall portion, the baffle wall portion having a first aperture allowing fluid communication between the first chamber and the second chamber, the first diverter having a deflecting surface oriented at a first angle to the baffle wall portion, a first portion of the connecting member attached to the first diverter and a second portion of the connecting member attached to the second diverter;

wherein the first diverter is positioned such that exhaust gasses flowing through the first aperture are deflected against the deflecting surface.

2. The muffler of claim 1, wherein the baffle wall portion is oriented orthogonally to a longitudinal axis of the casing.

3. The muffler of claim 1, wherein the baffle wall portion and the first and second diverters comprise a single, continuous piece of material.

4. The muffler of claim 1, wherein the first angle ranges from 20 degrees to 50 degrees.

5. The muffler of claim 1, wherein an outer perimeter of the diverter plate further comprises a flange that abuts said casing.

6. The muffler of claim 1, wherein the first aperture comprises a D-shape.

7. The muffler of claim 1, wherein an outer perimeter of the first diverter comprises the same shape as the first aperture.

8. The muffler of claim 1, wherein the diverter plate further comprises a second aperture.

9. The muffler of claim 8, wherein the shape of the first aperture comprises a mirror image of the shape of the second aperture.

10. The muffler of claim 8, wherein a total cross-sectional area of the first aperture and the second aperture is equal to or greater than a cross-sectional area of the inlet.

11. The muffler of claim 8, wherein the second diverter comprises a deflecting surface oriented at a second angle to the baffle wall portion, and exhaust gasses flowing through the second aperture are deflected against the deflecting surface of the second diverter.

12. The muffler of claim 11, wherein the first angle and the second angle are equal in magnitude but oriented in different directions.

13. The muffler of claim 1, wherein the first diverter and the second diverter have the same shape but opposite orientations.

14. The muffler of claim 1, the connecting member comprising an elongate portion oriented parallel to the baffle wall portion.

15. The muffler of claim 1, further comprising a splitter plate having a first portion oriented at an angle to a second portion, the first portion attached to the first diverter and the second portion attached to the second diverter, the splitter plate being separate and distinct from the baffle wall portion.

16. The muffler of claim 1, wherein no portion of the first diverter contacts the casing.

17. A muffler comprising:

a casing having an internal volume, an inlet and an outlet; and a diverter plate dividing the internal volume into a first chamber and a second chamber, the first chamber having the inlet, the second chamber having the outlet, the diverter plate comprising a first diverter, a second diverter and a baffle wall portion having at least one aperture, the first diverter and the second diverter oriented at equal but opposite angles with respect to the baffle wall portion, the at least one aperture allowing fluid communication between the first chamber and the second chamber;

wherein the first diverter and the second diverter extend into the second chamber.

18. A method of making a muffler comprising:

providing a casing having an internal volume;

providing a diverter plate comprising a baffle wall portion, a first diverter, a second diverter and a connecting member that is separate and distinct from the baffle wall portion, the baffle wall portion having an aperture, each diverter having a deflecting surface oriented at an angle to the baffle wall portion, a first portion of the connecting member attached to the first diverter and a second portion of the connecting member attached to the second diverter;

orienting the diverter plate within the internal volume of the casing such that the diverter plate divides the internal volume into a first chamber and a second chamber, the aperture allowing fluid communication between the first chamber and the second chamber; and securing the diverter plate to the casing.

19. The method of claim 18, wherein the step of providing a diverter plate further comprises providing a sheet of material and stamping the sheet to form the baffle wall portion, the aperture and the diverter.

20. The method of claim 19, wherein the stamping step further comprises forming a flange on an outer perimeter of the diverter plate.

21. The muffler of claim 1, wherein an area of attachment between the connecting member and the first diverter is offset from an area of attachment between the first diverter and the baffle wall portion.

22. The muffler of claim 21, wherein the area of attachment between the connecting member and the first diverter is located on a surface of the first diverter that is oriented opposite the deflecting surface.

* * * * *